US005373718A

United States Patent [19]

Schwerdt et al.

[11] Patent Number: 5,373,718

[45] Date of Patent: Dec. 20, 1994

[54] ELECTRONIC LOCK CYLINDER CONNECTABLE BY A PLUG CONNECTOR

[75] Inventors: Franz Schwerdt, Telgte; Thomas Wondrak, Dreieich; Karl-Heinz Spahn, Ostbevern; Dieter Wienert, Senden; Helmut Aswegen, Drensteinfurt, all of Germany

[73] Assignee: Aug. Winkhaus GmbH & Co. KG, Telgte, Germany

[21] Appl. No.: 27,646

[22] Filed: Mar. 8, 1993

[30] Foreign Application Priority Data

Mar. 6, 1992 [DE] Germany ..... 4207162
Oct. 12, 1992 [DE] Germany ..... 4234361

[51] Int. Cl.[5] ..... E05B 49/00

[52] U.S. Cl. ..... 70/278; 70/247; 70/277; 439/449; 340/825.31

[58] Field of Search ..... 70/277–282, 70/395, 413, 247; 235/375, 382, 492; 439/449, 456, 459, 460, 470; 307/10.1, 10.2; 340/825.31, 825.32, 542, 543; 361/172, 679, 732

[56] References Cited

U.S. PATENT DOCUMENTS

| | | | |
|---|---|---|---|
| 3,549,787 | 12/1970 | Churla | 439/449 X |
| 3,794,960 | 2/1974 | Sugar | 439/459 |
| 4,912,460 | 3/1990 | Chu | 340/825.31 |
| 4,980,680 | 12/1990 | Knoll et al. | 340/825.31 |
| 5,043,593 | 8/1991 | Tsutsumi et al. | 70/278 X |
| 5,092,148 | 3/1992 | Rong-Long | 235/382 X |
| 5,132,661 | 7/1992 | Pinnow | 340/825.31 |
| 5,136,196 | 8/1992 | Schmidt | 439/449 X |
| 5,171,155 | 12/1992 | Mendoza | 439/449 X |
| 5,186,031 | 2/1993 | Janssen et al. | 70/278 X |
| 5,197,312 | 3/1993 | Akutsu | 70/247 |

FOREIGN PATENT DOCUMENTS

| | | | |
|---|---|---|---|
| 0200912 | 3/1986 | European Pat. Off. . | |
| 364781 | 4/1990 | European Pat. Off. . | |
| 2444142 | 7/1980 | France . | |
| 8603271 | 5/1986 | Germany . | |
| 8700375 | 6/1987 | Germany . | |
| 8703403 | 6/1987 | Germany . | |
| 3727566 | 3/1989 | Germany . | |
| 3738906 | 5/1989 | Germany . | |
| 3800414 | 7/1989 | Germany . | |
| 2226593 | 7/1990 | United Kingdom . | |
| 8300976 | 3/1983 | WIPO | 70/277 |

*Primary Examiner*—Peter M. Cuomo
*Assistant Examiner*—Suzanne L. Dino
*Attorney, Agent, or Firm*—Brumbaugh, Graves, Donohue & Raymond

[57] ABSTRACT

A lock cylinder comprises a profile housing (1) with a cylinder core (9) disposed rotatably therein, and tumblers (15) which are controllable by a flat key. Disposed on the profile housing (1) is an information detector (37) which responds contactless to control information signals of a control circuit of the flat key, which is connected to an electronic control and power-supply circuit having at least some of its circuit components disposed separate from the lock cylinder. These circuit components are connected by a cable (43) and a plug connector (45) consisting of two plug parts (49, 51) complementary to one another. A first plug part (49) is mounted fixed on the profile housing (1), and the cable (43) bears a second, loose plug part (51) capable of placement on the first plug part (49).

22 Claims, 6 Drawing Sheets

Fig. 3
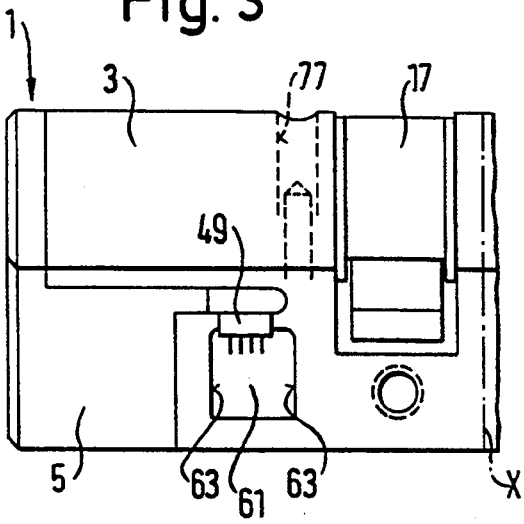
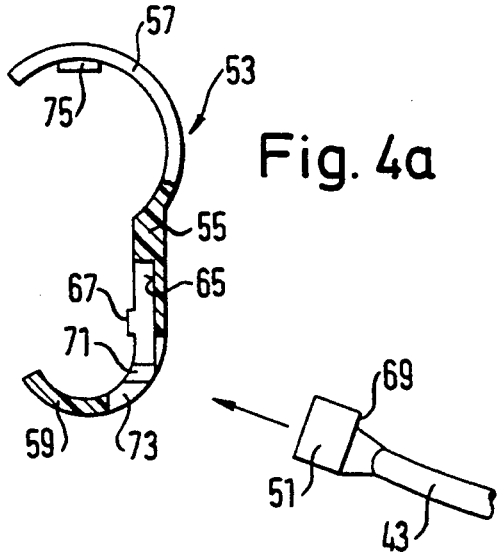
Fig. 4a
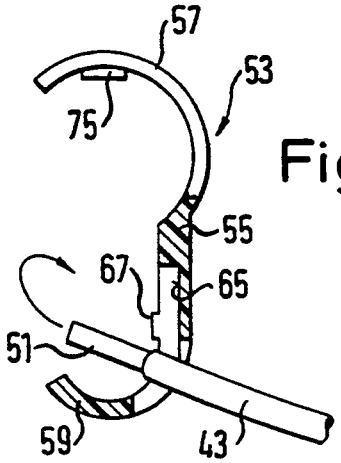
Fig. 4b
Fig. 5
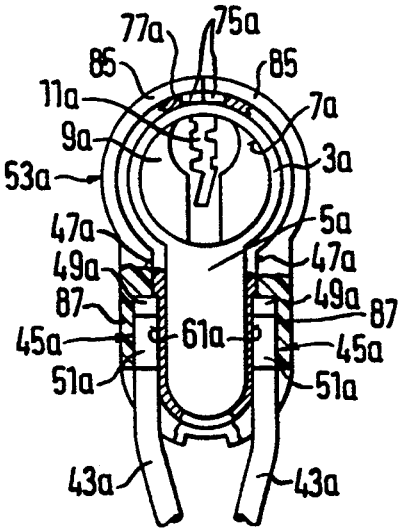
Fig. 6
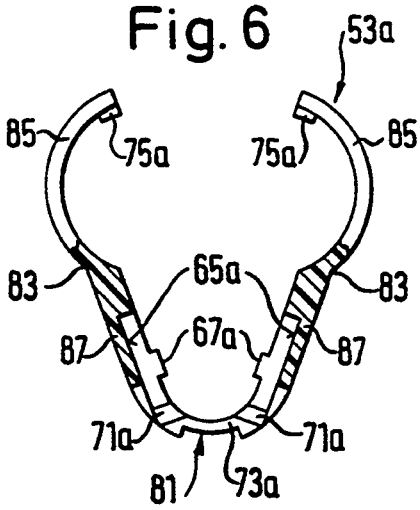

ELECTRONIC LOCK CYLINDER CONNECTABLE BY A PLUG CONNECTOR

BACKGROUND OF THE INVENTION

The invention concerns a lock cylinder, in particular an electronic lock cylinder connectable by a plug connector of a cable.

The term lock cylinder encompasses so-called profile semicylinders, which have a single cylinder core and associated structural components, and which are used especially with doors lockable by means of a key from one side only, e.g., garage doors and lockable equipment covers. Encompassed also are so-called double-lock cylinders with two cylinder cores and offering locking from two sides.

German Patent Document 8,700,375.9 discloses an electronic double-lock cylinder comprising two coaxially rotatable cylinder cores in bores of cylinder sections of its profile housing. The cylinder cores are lockable relative to the profile housing by mechanical tumblers and include a keyway, extending in the direction of the cylinder axis, for a flat key controlling the tumblers. The two cylinder sections of the profile housing are joined by a common root section projecting radially from the cylinder sections, and accommodate a lockable part capable of coupling alternately with the two cylinder cores. In addition to the mechanical locking function of the flat key, means are provided for transmitting control information, e.g., including coding information, between the lock cylinder and the flat key. Specifically, an information detection means responding contactless to control information signals of a control circuit of the flat key is disposed at the profile housing in the region of at least one of the cylinder cores. The information detection means at the profile housing is connected to a control and power-supply circuit disposed with at least some of its circuit components separate from the lock cylinder, i.e., externally, by means of a cable which includes a plug connector. In the known lock cylinder, the plug connector is disposed at the free end of a cable section connected firmly to the lock cylinder by its other end. Thus, the plug connector in a lock cylinder installed in a lock is exposed to possible damage upon installation of the lock cylinder as well as in use.

An inset door lock with an electronic profile lock cylinder is disclosed in European Patent Document EP-A-364,781. A region of the root section of the profile housing located within the door lock in the installed state includes a first plug part, firmly joined with the root section, of a plug connector contacting the electronic lock cylinder. The second plug part of the connector is disposed on a slide within the inset door lock, displaceable by means of a screw. Although the plug connector of the known lock is comparatively well protected within the door lock, it requires relatively extensive structural adaptation of the door lock to the profile cylinder. In particular, extensive precautionary measures are required to align the lock cylinder, disposed in a profile hole of the door lock, relative to the second plug part located on the slide and to avoid damage to the sensitive contacts of the plug parts.

SUMMARY OF THE INVENTION

It is an object of the invention to provide a mechanically lockable lock cylinder of the above type, equipped for the transmission of electrical control information signals, which permits reliable plug connection to a cable with comparatively little expenditure for structural parts.

A preferred lock cylinder comprises a profile housing, at least one cylinder core disposed rotatably in a bore of the profile housing and lockable relative to the profile housing by mechanical tumblers, with a keyway extending in the direction of the cylinder axis for a flat key controlling the tumblers and an information detection means disposed at the profile housing and responding contactless to control information signals of a control circuit of the flat key. The information detection means is connected to an electronic control and power-supply circuit disposed with at least some of its circuit components separate from the lock cylinder, connection of the circuit components separate from the lock cylinder being by way of a cable and a plug connector consisting of two plug parts complementary to one another.

A first one of the two plug parts is firmly mounted on the profile housing. The cable has a second loose plug part capable of slipping on the first plug part. A retaining part which engages behind the second plug part at least in the direction of unplugging and which secures it relative to the first plug part, in particular against unplugging of the first plug part, is attached to the profile housing.

BRIEF DESCRIPTION OF THE DRAWING

FIG. 3 is a side view of the lock cylinder before connection of a cable;

FIGS. 4*a* and 4*b* are side views of a clamp;

FIG. 5 is a front view, partially cut away, of a variant lock cylinder with two cables to be connected by plug connectors;

FIG. 6 is a side view, partially cut away, of a clamp useful for securing the plug connectors of FIG. 5 before installation;

DETAILED DESCRIPTION OF PREFERRED EMBODIMENTS

Figure 1:
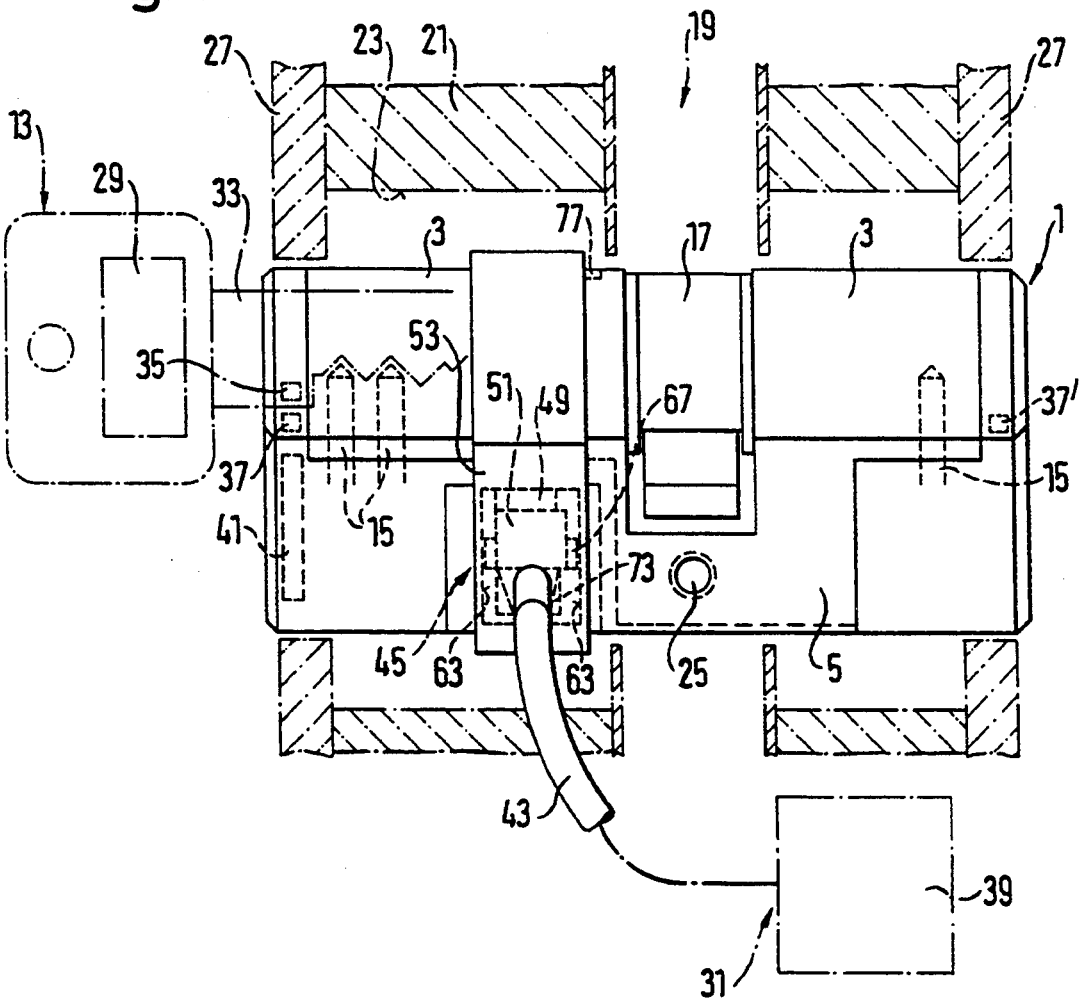
FIG. 1 is a side view of an electronic double-profile lock cylinder, installed in a schematically shown door.

In a preferred lock cylinder, the first plug is fixed and permanently wired at the profile housing, displaced in the direction of the cylinder axis against the lockable part of the lock cylinder coupled with the cylinder core. No excessive tensile loads may be applied to the wiring, as the mounting attachable to the cylinder housing is subjected to any tensile forces acting by way of the cable.

As customary in conventional profile lock cylinders, the profile housing advantageously comprises a cylinder section including the bore for the cylinder core and a root section which is limited by two side faces, which projects radially from the cylinder section on the cylinder axis, and which extends approximately parallel along the cylinder section. In a preferred embodiment of a profile lock cylinder, the first plug part is disposed on one of the side faces with the direction of unplugging along the side face and, in particular, with the direction of unplugging transversely away from the cylinder section. Thus, the free space typically present in the cylinder-accommodating bore of the door, due to the fairly narrow cross-sectional width of the root section, can be utilized for accommodating the plug connector and the retaining part. In particular, when the direction of unplugging of the plug is transverse, e.g., perpendicular, to the cylinder section and parallel to the side face of the root section, there result especially favorable mounting conditions, as the cable runs from the plug connector already lying in the plane of the door leaf.

Additional improvement in reliability of operation of the described plug connector is realized in that the retaining part overlaps at least the second plug part in the direction of unplugging as well as transverse thereto in both directions and fixes it relative to the profile housing between stops facing one another. In this embodiment, the retaining part protectively covers the second plug part and the transition region between the two plug parts as well, thereby reducing the risk of fouling and corrosion. Also, the second plug part is secured not only against unplugging, but against transverse stresses as well, such as might arise, e.g., when a door is slammed shut. These stops may be noses or ribs or the like. Advantageously, the retaining part, in its face adjacent to the side face of the root section, includes a depression into which both plug parts engage together. Thus, the retaining part overlaps both plug parts.

For fixing of the second plug part on the retaining part relative to the first plug part, the retaining part is fixed on the profile housing. Since, typically, the plug parts are relatively small, e.g., having transverse dimensions of only a few millimeters, comparatively narrow fixing tolerances are required when the sensitive plug contacts are to be sufficiently protected against mechanical stress. Forces acting transverse to the direction of unplugging can be diverted securely to the profile housing if at least the second plug part is disposed in a depression of the side faces of the root section limited by shoulders in a direction of unplugging on both sides of the second plug part at a distance from the latter, and if the retaining part has projections on both sides of the second plug part which engage in the depression and fix the second plug part and the retaining part on the profile housing transverse to the direction of unplugging. Advantageous in several respects, the depression in the side face of the root section of the profile housing not only countersinks the plug connector at least partially in the profile housing, but also serves for fixation of the second plug part of the retaining part.

For fixation of the retaining part on the profile housing, mutually complementary locking members may be provided on the retaining part and on the profile housing. Alternatively, the retaining part may be fastened detachably to the profile housing by additional fastening means, e.g., a screw. To avoid additional locking recesses on the profile housing, the retaining part in a preferred embodiment extends beyond the side of the cylinder section diametrically away from the root section, and bears at least one catch which engages in a guide bore of at least one of the tumblers, e.g., the guide bore of the innermost tumbler. While in conventional profile lock cylinders the guide bores of the tumblers are closed off by stoppers, this is not the case here, and the guide bore is simultaneously utilized as a locking recess for the catch.

In embodiments in which the first plug part is disposed so that the direction of unplugging is transverse, in particular at a right angle, away from the cylinder section, a preferred embodiment has the retaining part extending beyond the side of the cylinder section turned diametrically away from the root section. Thus, the retaining part can transmit forces exerted by way of the cable and the second plug part directly to the profile housing, without additional fastening members or the like being required. In a refinement of this embodiment, the retaining part is designed as a clamp adapted to the cross-sectional contour of the profile housing, to be slipped on the profile housing transverse to the cylinder axis. Advantageously, the clamp is substantially U-shaped, with a first arm engaging the cylinder section and a second arm engaging the face of the root section located distant from the cylinder section, covering the two plug parts with its crosspiece connecting the arms. Such a clamp not only protects the plug parts, but can be snapped easily onto the profile housing, which facilitates assembly of the profile cylinder.

To reduce fixation of the second plug part and the space requirement of the plug connector as a whole, at least the second plug part preferably is designed as a flat plug part resting flat on the root section. Also, in such a flat plug part, the retaining part can be made for problem-free installation on the cable immediately before assembly of the profile lock cylinder. For this purpose, the clamp may be provided with a cable passage opening in the region of the edge of the root section located distant from the cylinder section, which passage, transverse to the clamp as viewed along the side face of the root section, is more narrow than the flat-side width of the flat plug part, and which passage has an opening width along the clamp that permits passage of the flat plug part. Thus, the clamp can be slipped on the cable turned 90° from its mounting position as referred to the flat plug part, and, turned back into its mounting position, the clamp secures the second plug part at least in the direction of unplugging. Here, the cable passage opening preferably engages the edge of the root section. This has the advantage that, when the plug connector is closed, the clamp can first be put on the root section with its second arm and then, carried on the root section, be snapped onto the cylinder section with its first arm. This facilitates placement of the clamp relative to the plug connector.

For providing sufficiently great stop or shoulder surfaces on the comparatively small second plug part for security against unplugging, the cable is advantageously connected to the second plug part eccentric to the center thereof.

For some applications, the electronic lock cylinder has to be connected by means of two separate cables and two separate plug connectors to the circuit components of the electronic control and power-supply circuit disposed separate from the lock cylinder. This may be the case when the number of lines to be connected will so enlarge the cross section of the cable that a single cable would be too stiff and too thick to be placed inconspicuously, or when the individual lines of the cable are to be separated spatially from one another for reasons of safety and radiation interference. Two connecting cables are used to advantage when the lock cylinder is a double-lock cylinder whose profile housing includes two cylinder cores separated from one another axially into two cylinder sections by a lockable part, and joined into one unit by a common root section, where separate information transmitting means for the transmission of control information signals of the flat key may be assigned to the two cylinder cores. If the control information signals of the two information transmitting means are supplied separately to the external control and power-supply circuit, the side from which a door is locked may be monitored, e.g., in access-control systems. To facilitate assembly of a lock cylinder whose two separate cables are to be connected, it is advantageous for each of the two cables to bear a second plug part secured against unplugging by a common retaining part. The corresponding first plug parts may be attached to the root section of the profile housing. The two first plug parts may be disposed side by side on the same side face of the root section. Since, in some cases, this requires a comparatively large-area retaining part exposed to strong forces because of the unsymmetrical load, in a preferred design the first plug parts are disposed on side faces of the root section facing one another, and the retaining part is a clamp enclosing the profile housing between two arms extending transverse to the cylinder axis, with each of the arms having means for fixing the second plug part. The clamp may be essentially U-shaped, for placement on the profile housing either from the side of the cylinder section or from the side of the root section. However, fixation of the clamp on the profile housing is improved if the arms have a shape adapted to the cross-sectional contour of the profile housing, and if they surround the profile housing substantially completely.

In an embodiment of the clamp as a substantially closed ring, arms with material and shape suitably selected may have sufficient inherent elasticity for the clamp to be snapped onto the profile housing. Alternatively, the arms may meet in a joint and, at their ends distant from the joint, bear locking members for fixation on the profile housing. If the joint connects the ends of the arms adjacent to the root section, the relatively large peripheral surface of the cylinder section may be utilized for accommodation of the locking members, which further permits snapping of the locking members into guide bores of the tumblers.

Not only in a double-lock cylinder, but also in a so-called profile semicylinder, connection is possible by means of two or more cables and two or more separate plug connectors to the circuit components of the electronic control and power-supply circuit disposed separate from the lock cylinder, in particular if a large number of lines are to be connected, with fixation of the second plug parts and/or the retaining part as described above.

According to one embodiment of the invention, the profile housing of a double-lock cylinder includes two cylinder cores separated from each other axially into two cylinder sections by a lockable part and joined into a unit by a common root section, where separate information detection means are assigned to each of the two cylinder cores for the transmission of control information signals of the flat key, and where both information detection means are connected to the electronic control and power-supply circuit, whose circuit components, disposed separate from the lock cylinder, are connectable by means of a single cable and a single plug connector. Aside from the fact that the number of plug contact elements is optionally variable, the plug connection and the retaining part for fixation of the second plug part borne by the cable may have any one of the designs described with reference to other embodiments of the invention. Functions such as monitoring by means of an access-control system, of the side from which the door is locked or unlocked, are not jeopardized by the connection configuration with an individual plug connection.

An additional preferred embodiment of the invention includes a lock cylinder whose profile housing has a cylinder section with a bore for the cylinder core, and a root section projecting radially from the cylinder section on the cylinder axis, delimited by two side faces extending substantially parallel along the cylinder section, where the first plug part is disposed in the region of one of the side faces, preferably in a depression of the root section in the region of the one side face, with the direction of unplugging transverse, in particular perpendicular, to the side faces. Thus, the free space typically present in the cylinder-accommodating bore of the door can accommodate the plug connection and the retaining part.

Especially favorable mounting conditions are realized in this variant of the plug connection if, as provided according to another refinement, the first plug part is accommodated in a depression of the root section in the region of the one side face to such an extent that it does not project outward beyond the side face. Thus, the first plug part is well protected against damage and does not take up space outside the profile housing.

If design requirements call for a depression in the root section with minimal depth, the first plug part, utilizing the advantages mentioned above, should terminate substantially flush with the one side wall. If the depression may be deepened, and if the first plug part can be placed behind the one side face of the root left in the depression, the second plug part should be adapted so that, in the connected state, one part of its plug housing engages in the depression. As a result, lateral forces acting on the second plug part, i.e., forces transverse to the direction of unplugging, can then be transmitted to the profile housing by the plug-housing part engaging in the depression and by side faces of the depression closely adjacent thereto. Furthermore, effective sealing of the plug connection can be realized to protect the plug connections against the penetration of moisture.

The first plug part preferably is an integral component of a structural unit comprising circuit components of the control and power-supply circuit, disposed in the depression as described above. For example, such a structural unit may be a circuit chip, already fitted with electronic components and perhaps having connector sockets for the first plug part, and readily disposed in a corresponding depression in the root section. The lock cylinder, including the circuit chip and the first plug part, may be economically preassembled. In preassembly, protection and securing can be given attention in the placement of profile-housing side current-carrying lines in the root section. Installation of a lock cylinder outfitted in this way in a door or in a lock housing requires no special precautionary measures and may be effected substantially in accordance with the procedure for installation of a conventional mechanical lock cylinder.

According to a further embodiment of the invention, at least one of the plug parts, near its electrical contact elements, has plug-guidance and fixing members which, with alignment of the electrical contact elements of the two plug parts complementary to one another, are capable of insertion in plug-guidance and fixing openings in the region of the other plug part, the electrical contact elements of the plug part provided with plug-guidance and fixing elements preferably not projecting outward from the plug part beyond the plug-guidance and fixing members.

A variety of plug contacts, such as, e.g., ball contacts and surfaces complementary thereto, so-called conductive rubber contacts (conductive zebra rubber) and spring contacts and contact surfaces corresponding thereto, may be considered as electrical contact elements. The plug-guidance and fixing members and the plug-guidance and fixing openings ensure that the connected state can be produced only when corresponding contact elements are properly aligned. Thus, electrical short circuits and other faulty connections can be avoided. Furthermore, the plug-guidance and fixing members provide fixation of the two plug parts relative to one another transverse to the direction of unplugging, owing to which corresponding electrical contact elements maintain their correct alignment in the connected state.

In a particularly advantageous plug connection, a pin-socket plug connection with at least one of the plug parts having a pin contact for coupling with a corresponding socket contact of the other plug part, comprises plug-guidance and fixing members near the pin contacts, oriented substantially parallel thereto and projecting beyond the pin contacts, in particular guidance pins, for insertion in plug-guidance and fixing openings of the other plug part upon alignment of the pin contacts to the socket contacts. The plug-guidance and fixing members and the plug-guidance and fixing openings complementary thereto ensure simple coupling of the two plug-connection parts and ensure that any incorrect coupling of the two plug parts is prevented. Furthermore, the plug-guidance and fixing members may be disposed relative to the pin contacts so that they protect the latter from damage even when the two plug parts are separated from one another. In particular, the plug-guidance and fixing members prevent the pin contacts from being damaged by lateral forces in the connected state by transmitting any lateral forces into the housing of the other plug part, and through it into the profile housing.

Plug-guidance and fixing members advantageously may be pins. However, they may alternatively be stud elements disposed about the pin contacts, in particular when the second plug part bears pin contacts.

In a lock cylinder with the direction of unplugging transverse to one of the side faces of the root section, the cable advantageously is led away from the second plug part transverse to the direction of unplugging, in particular substantially perpendicular thereto, in a direction away from the cylinder section. In this way, the free space typically present in the cylinder-accommodating bore of the door because of the more narrow cross-sectional width of the root section, can be used with minimum space take-up for leading the cable away from the second plug part.

The retaining part and the second plug part, in the connected state, advantageously have fixing elements in mutual engagement, fixing the two respective parts relative to one another transverse to the direction of unplugging, in particular in the direction along the cylinder axis. In connection with the plug-guidance and fixing members described above, on at least one of the plug parts and the plug-guidance and fixing openings complementary thereto in the other plug part, the entire structural group of the second plug part and retaining part is fixed against displacements transverse to the direction of unplugging, whereby the plug contacts are protected against shear stresses. In this embodiment, direct fixation of the retaining part on the profile housing in the direction transverse to the direction of unplugging may be dispensed with, with attendant advantages in production.

Advantageously, in the retaining part the second plug part is transverse to the direction of unplugging between accommodating shoulders as fixing elements.

Advantageously further, fixation transverse to the direction of unplugging is realized in that the retaining part engages behind the second plug part in the direction of unplugging with a wall section having a locking aperture or a catch as fixing element, with the second plug part having a catch as fixing element engaging in the locking aperture, or a locking aperture receiving a catch of the wall section.

In the embodiment of the lock cylinder with the direction of unplugging running transverse to a side face of the root section, a clamp may be used as the retaining part, adapted at least sectionwise to the cross-sectional contour of the profile housing and capable of placement on the profile housing.

The clamp may be slipped onto the profile housing, in particular in the longitudinal direction of the cylinder section. Also, the clamp may be made of spring band steel. With utilization of the elastic spring forces of such a clamp, the second plug part may be secured especially effectively relative to the first plug part.

In a preferred embodiment, the clamp has an upper clamp section engaging the cylinder section from the side face of the root section distant from the plug connection, with a free end engaging behind the second plug part, and a lower clamp section engaging with a free end the edge of the root section distant from the cylinder section from the side face of the root section distant from the plug connection. By simple means, such a clamp can be brought into its operative position on the profile housing. The gap in this clamp between the free ends of the integrally connected sections can be utilized for passage of the cable from the second plug part, or for part of the plug housing of the second plug part. Thus, such a clamp performs multiple important functions and, moreover, can be produced in simple and economical fashion.

According to another variant, the retaining part a retaining band passing between two projections of the second plug part for its fixation transverse to the direction of unplugging and capable of being wrapped about the profile housing and the second plug part, in particular a retaining band locking automatically against loosening upon tightening. Such self-locking retaining bands are known in electrical technology, for example, as cable clamps to bundle a plurality of individual cables into one strand. E.g., the retaining band may pass through a groove on the side of the second plug part distant from the profile housing. Alternatively or additionally, it may be pulled through one or several loops on the backside of the second plug part. Such a retaining band is particularly inexpensive, and it affords simple assembly.

For protection of the plug contacts of the plug connection from moisture, dust and the like, at least one of the plug parts is provided with a seal. E.g., a sealing disk may be disposed on the contact-side face of the plug part concerned. An elastic sealing bead may also be used, e.g., surrounding the edge of a plug part on its contact side.

Specific preferred embodiments of the invention are described below with reference to the drawing.

Figure 2:
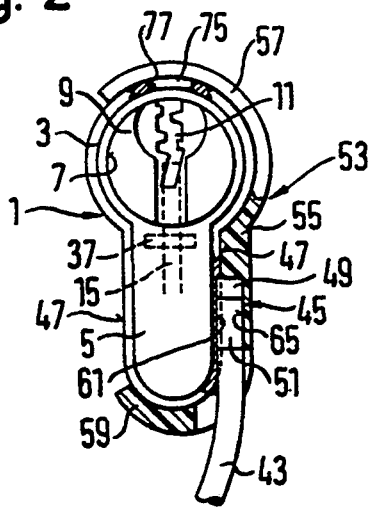
FIG. 2 is a front view, partially cut away, of the lock cylinder of FIG. 1.

The double-profile lock cylinder shown in FIGS. 1 and 2 comprises a profile housing 1 with two cylinder sections 3, disposed side by side coaxially, which are joined together by a common root section 5 projecting radially from the cylinder sections 3 and extending over the entire axial length of the profile housing 1. Each cylinder section 3 includes, in a bore 7 (see FIG. 2), a cylinder core 9 with a keyway 11 for a flat key 13. The cylinder cores 3 are conventionally lockable mechanically relative to the profile housing 1 by a plurality of tumblers 15. The flat key 13 controls the tumblers 15 in the usual fashion. A lockable part 17, which is capable of coupling alternately with each of the cylinder cores 9, is disposed axially between the cylinder sections 3.

FIG. 1 schematically illustrates installation of such a profile lock cylinder in an inset door lock, indicated at 19 by its flat side walls, of a door 21 having a lock-inset opening 23. The profile lock cylinder 1 is disposed with its lockable part 17 within the inset door lock 19 and is attached by a penetrating screw 25 screwed into the root section 5.

Regions of the profile housing 1 project beyond the door leaf 21 and engage into the doorplates 27, terminating substantially flush. The doorplates 27 also serve as covers for the opening 23.

The flat key-lock cylinder combination not only has a mechanical locking function, but additionally provides for contact-free transmission of control information signals between a control circuit 29 integrated into the flat key 13 and a control and power-supply circuit 31 for the lock cylinder. For this purpose, the flat key 13 includes, for example in its key shank 33, an information transmitting element 35, which is coupled contact-free with an information transmitting element 37 disposed in the profile housing 1 at a location aligned with the element 35 when the flat key 13 is inserted. The elements 35, 37 may, e.g., be coupling coils for inductive coupling. The control and power-supply circuit transmits, by way of the elements 35, 37, the electrical power required for operation of the control circuit 29 and optionally transmits control signals which synchronize the operation of the control circuit 29 with the operation of the circuit 31. Particularly, he control information signals transmitted by the control circuit 29 are coding data which are compared in the control and power-supply circuit for correspondence with lock-cylinder-side coding data. The circuit 31 may be a component of an super-ordinate system, e.g., an access-control system or an alarm system. Alternatively, it may control an additional locking function of the lock cylinder, which for this purpose may comprise a locking means, e.g., an electromagnetically actuable locking means (not illustrated in detail), controllable by control signals of the circuit 31, which additionally blocks the cylinder core 9 relative to the profile housing 1, and which is unlocked upon correspondence of the coding information transmitted between the circuits 29, 31.

The control and power-supply circuit 31 is disposed with at least some of its electronic components outside the profile housing 1, as illustrated at 39. Alternatively, as illustrated at 41, it may comprise circuit components disposed within the profile housing 1. In either case, the externally disposed circuit components 39 of the circuit 31 are connected by way of a multi-wire flexible cable 43 and a plug connector 45 to the information transmitting element 37 and, optionally, to the circuit components 41 of the lock cylinder. As shown in FIG. 2, the plug connector 45 comprises a first plug part 49, disposed fixed on one of the two side faces 47 of the root section 5 parallel to one another, on which a second plug part 51, attached at the end of the cable 43, can be placed parallel to the side face 47 and at right angles to the cylinder section 3, or from which the plug part 51, oppositely directed, is removable. A substantially U-shaped clamp 53, made of elastic synthetic material, fixes the cable-side plug part 51, in the direction of unplugging as well as transverse thereto, to the profile housing 1. The clamp 53 has a shape adapted to the cross-sectional contour of the profile housing 1 and covers the plug connector 45 with its crosspiece 55. Arms 57, 59 adjoin the cross piece 55 on both sides, form-lockingly engaging over the cylinder section 3 or the edge of the root section 5 distant from the cylinder section 3, and holding the clamp 53 on the profile housing 1.

The plug parts 49, 51 are disposed in a depression 61 of the side face 47 of the root section 5, which extends without undercut to the edge of the root section 5 distant from the cylinder section and is limited transverse to the plug-in direction of the plug connector 45 by shoulders 63. The shoulders 63 are at a distance from the plug part 51. Projections 67 are formed on the crosspiece 55 of the clamp 53 on both sides of a recess 65 accommodating the plug parts 49, 51, which projections engage between the plug part 51 and the shoulders 63 and fix the clamp 53 as well as the plug part 51 transverse to the plug-in direction of the plug connector 45 on the profile housing 1.

For fixation of the plug part 51 in the direction of unplugging, by eccentric connection of the cable 43, a stop 69 is formed on the side of the plug part 51 pointing toward the cable 43, opposed in the direction of unplugging by a shoulder 71 of the recess 65 formed in the crosspiece 55 of the clamp 53. Thus, the clamp 53, supported by its arm 57 on the cylinder section 3, also secures the plug part 51 in the direction of unplugging relative to the profile housing 1.

Connection of the cable 43 to the lock cylinder is illustrated by FIGS. 3, 4*a* and 4*b*. FIG. 3 shows the region of the plug part 49 which forms the pin part of the plug connector 45. The plug part 51, formed as a flat plug part with a substantially parallelepiped-shaped plug body and with its flat side resting on the bottom of the depression 61, is slipped on the plug part 49. The clamp 53, which forms a structural part separate from the plug part 51 and the cable 43, is slipped on the cable 43 beforehand. In the region of transition from its crosspiece 55 into the arm 59, it has an opening 73 which, transverse to the longitudinal direction of the clamp 53, is more narrow by at least the width of the shoulder 71 than the corresponding dimension of the plug part 51. In the longitudinal direction of the clamp 53, the opening 73 is wider than the flat-side dimension of the plug part 51, so that the plug part 51, as indicated in FIG. 4a, can be inserted through the opening 73 of the clamp displaced 90° from its operative position and can then be turned into its locking position (see FIG. **4*b*), in which the stop face 69 of the shoulder 71 lies opposite. After slipping the plug part 51 onto the plug part 49, the arm 59 of the clamp 53 is placed on the root section 5 and the arm 57 of the clamp 53 is snapped onto the cylinder section 3, whereupon the plug parts 49, 51 are introduced into the recess 65**.

For additional fixation of the arm 57 on the cylinder section 3 of the profile housing 1, a catch 75 is formed on the inner side of the arm 57, which engages in an opening 77 on the top of the cylinder section 3. The opening 77 advantageously is the housing bore, included for introduction of the tumblers 15, which, unlike the other tumbler bores of the profile housing 1, is not closed off. The innermost bore, viewed axially, is employed here for securing the clamp 53.

Although a double-lock cylinder has been described by way of example, the description also applies to a profile semicylinder, which, instead of two cylinder cores, has only one cylinder core, and whose profile housing is correspondingly shortened in the axial direction, as indicated in FIG. 3 by a chain-dotted line X which marks the right-hand edge of a corresponding profile semicylinder in the drawing.

Profile semicylinders are used in doors, e.g., in garage doors or equipment covers, which are intended to be lockable by means of a key from one side only.

In addition to the information transmitting element 37 described above, the lock cylinder may comprise another information transmitting element assigned to its second cylinder core, as indicated at 37'. The two elements 37 and 37' may be connected by a common plug connector 45 and a common cable 43 to the control and power-supply circuit 31. Since, in some cases, this requires a comparatively thick and hence stiff multi-wire cable, two separate cables may alternatively be connected to the lock cylinder by way of plug connectors. Separate cables may also be used in a single information transmitting element which requires a multi-wire cable for its operation. In the variant of FIGS. 5 and 6, the structural components corresponding to those of the lock cylinders of FIGS. 1 to 4 have the same numerals, with an appended "a". The description of FIGS. 1 to 4 can be used with FIG. 5 and 6.

Separate plug connectors **45*a*, which are disposed on side faces 47*a* of the root section 5*a* facing one another, are assigned to the two cables 43*a* to be connected. A clamp 53*a*, form-lockingly adapted to the cross-sectional contour of the profile housing and surrounding the profile housing annularly, fixes the cable-side plug parts 51*a* of the two plug connectors 45*a* together on the profile housing, while the profile-housing side plug parts 49*a* are in turn mounted firmly on the root section 5*a*. The clamp 53*a* consists of two arms 83, joined together in one piece by way of a flexible articulated region 81, with a region 85 surrounding the cylinder section 3*a* of the profile housing and a root region 87 following the root section 5*a*. The articulated region 81 connects the ends of the crosspiece regions 87 and also delimits an insert opening 73*a* for slipping the clamp 53*a* on the two cables 43*a*. The clamp 53*a* includes in its two crosspiece regions 87 recesses 65*a* with projections 67*a* and shoulders 71*a* for fixing the plug parts 51*a* on the profile housing. The plug parts 49*a*, 51*a* are disposed in depressions 61*a* as described. Catches 75*a*, which together engage in an aperture 77*a* on the top of the cylinder section 3*a*, are formed on the ends of the cylinder regions 85. The opening 77*a*** may be formed by an open bore for receiving one of the tumblers, in particular the axially innermost tumbler.

Other exemplary embodiments of the invention are described below. Parts or elements which in terms of their function are substantially equivalent are identified by the same reference numerals and a following lowercase letter. These embodiments are described in terms of differences from the examples already described. Combination of elements of these examples with elements of examples already described is not precluded.

Figure 7B:
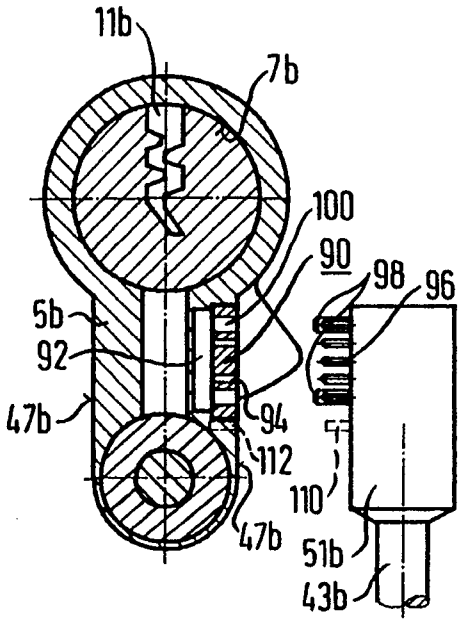
FIG. 7*b* is a cross section of the lock cylinder of FIG. 7*a*, along the line b—b in FIG. 7*a*, with an unplugged second plug part.

In the embodiment of FIGS. **7*a* to 7*d*, the first plug part 49*b* is an integral component of a circuit chip 90, which optionally bears electronic components of the control and power-supply circuit. The chip 90 is disposed in a depression 92 in the region of one of the side faces 47*b* of the root section 5*b*, and one flat side of the chip 90 ends substantially flush with the side face 47*b*. The first plug part is defined in that plug sockets 94 are provided in the circuit chip 90, for receiving pin contacts 96 of the second plug part 51*b*. The plug sockets 94 are oriented so that the direction of unplugging of the plug connection 49*b*, 51*b* runs substantially perpendicular to the side faces 47*b* of the root section 5*d*, as shown in FIG. 7*d*** showing the connected state.

The second plug part **51*b* has a substantially parallelepiped-shaped plug housing with pin contacts 96 projecting laterally, and a cable lead oriented in a direction away from the cylinder section 3*b*** and substantially parallel to these pin contacts.

The second plug part has plug-guidance and fixing members in the form of pins 98 which project from the plug housing of the second plug part **51*b*, parallel to the pin contacts 96 and projecting beyond their length, and which engage in complementary plug-guidance and fixing openings 100 in the chip 90. The plug-guidance and fixing pins 98 and the associated openings 100 ensure that the plug connection can be coupled only when the pin contacts 96 and the corresponding sockets 94 are properly aligned. In addition, they ensure that, in the connected state, no shear forces damaging the pin contacts 96 act on the pin contacts 96, as they absorb forces transverse to the direction of unplugging and, by way of the chip 90, divert them to the profile housing 1*b*. For fixation of the second plug part 51*b* relative to the first plug part 49*b*, there is provided a clamp 53*b* of spring band steel which is adapted sectionwise to the contour of the profile housing 1*b* and which has an upper section 57*b*, engaging about the cylinder section 3*b* from the side face of the root section 5*b* distant from the plug connection 49*b*, 51*b*, with a free end 102 engaging behind the second plug part 51*b*, and a lower clamp section 59*b* engaging with a free end 104 about the edge of the root section 5*b* lying distant from the cylinder section 3b from the side face of the root section 5b distant from the plug connector. The end section 102 of the clamp 53b engaging behind the second plug part 51b rests, with substantially its entire surface overlapping the second plug part 51b on its back, on the plug housing of the second plug part 51b, so that it presses on the second plug part 51b by the spring force of the clamp 53b, substantially parallel to the direction of unplugging. Thus, the second plug part is securely fixed parallel to the direction of unplugging. On the end section 102 of the clamp 53b, there are formed lateral tabs or shoulders 106 which project toward the root section 5b and enclose the second plug part form-lockingly between them in the direction along the axis of the cylinder section 3b, thus ensuring fixation of the second plug part 51b** transverse to the direction of unplugging.

Between the two free ends 102 and 104, the clamp 53b has a gap which is used for leading the cable 43b substantially perpendicular to the pin contacts 96 in the direction away from the cylinder section 3b.

Figure 7A:
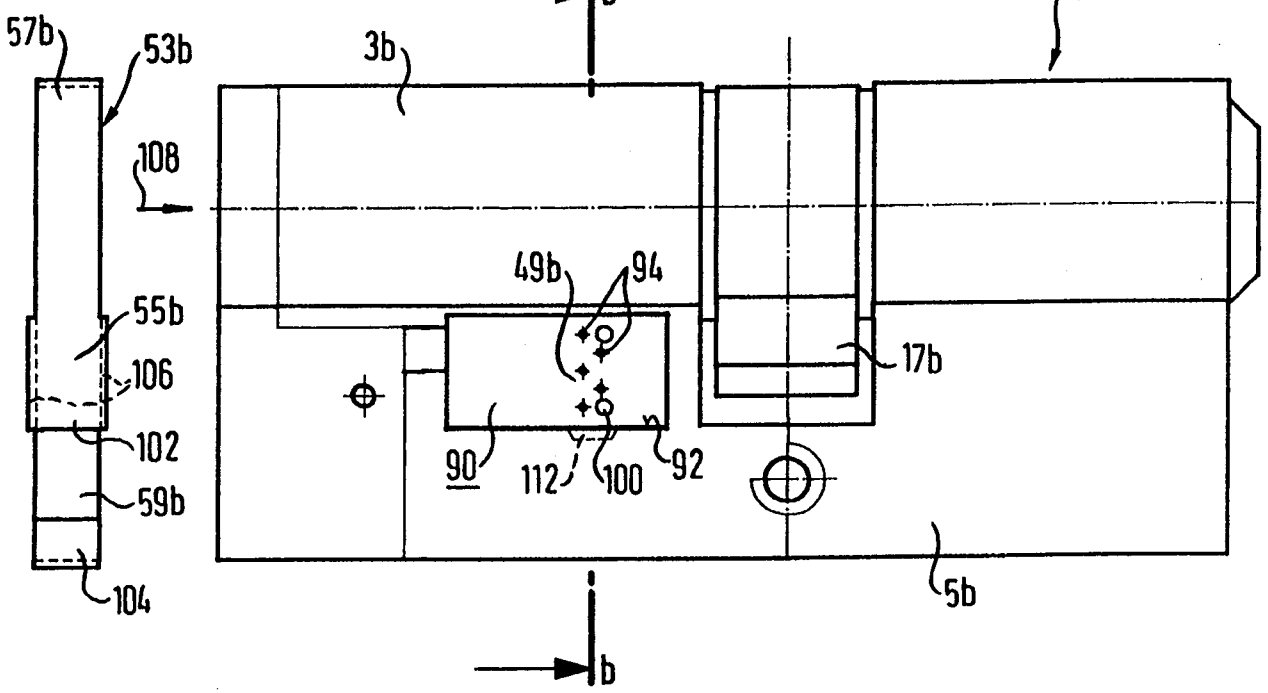
FIG. 7*a* is a side view of a lock cylinder according to another preferred embodiment, wherein the direction of unplugging runs substantially perpendicular to a side face of a root section.
Figure 7D:
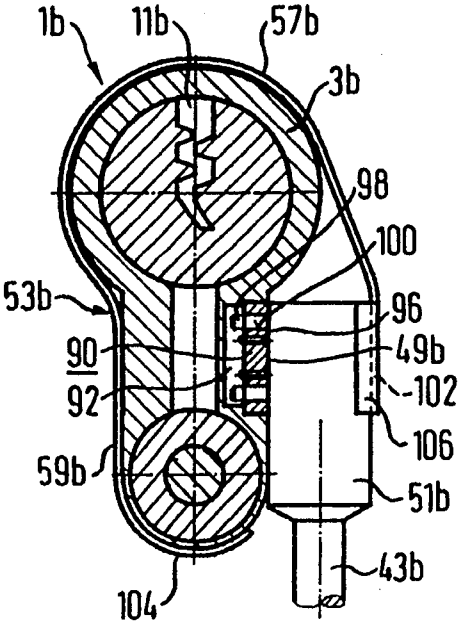
FIG. 7*d* is a cross section of a profile housing of FIG. 7*c*, along line d—d in FIG. 7*c*, the plug parts being connected.
Figure 7C:
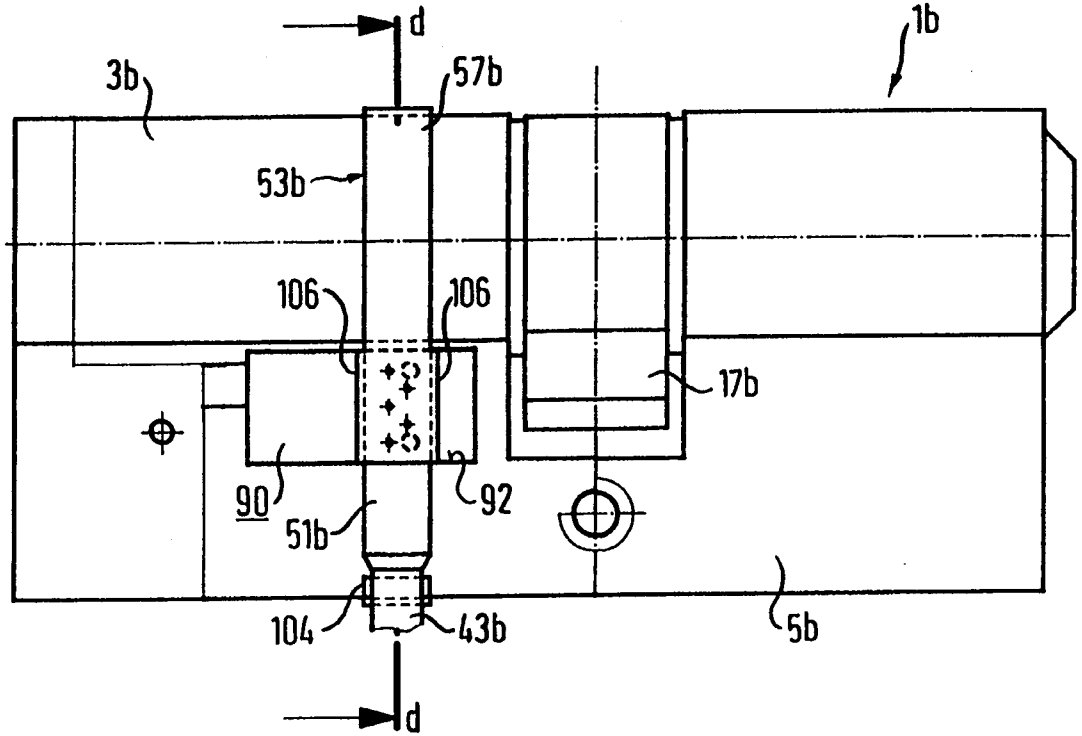
FIG. 7*c* is a side view of the lock cylinder of FIGS. 7*a* and 7*b* with a retaining part in place.

As indicated by the arrow 108 in FIG. 7a, the clamp 53b may be slipped onto the profile housing 1b in the direction along the cylinder section 3b, optionally with the aid of a spreading tool, and brought into its mounting position. Alternatively, an analogous clamp can be used for snapping onto the profile housing transverse to the cylinder section.

Owing to cooperation of the plug-guidance and fixing pins 98 and the associated openings 100, as well as of the shoulders 106 and the closely adjacent regions of the plug housing of the second plug part 51b facing them, excellent fixation of the plug connection 49b, 51b is obtained in the direction of unplugging as well as transverse thereto. In addition, the clamp is simultaneously axially fixed relative to the profile housing, making it possible to dispense with separate axial fixing elements for direct fixation of the clamp on the profile housing. Use of such elements, fixing the clamp 53b in axial direction of the cylinder section 3b directly to the profile housing 1b, is not precluded.

As indicated in FIGS. 7a and 7b by broken lines, a projecting element 110 may alternatively be disposed on the second plug 51b, which, in the connected state, engages in a complementary opening 112 in the side wall 47b of the root section 5b. As a result, any transverse forces acting on the second plug part 51b are diverted directly to the profile housing 1b.

Figure 8:
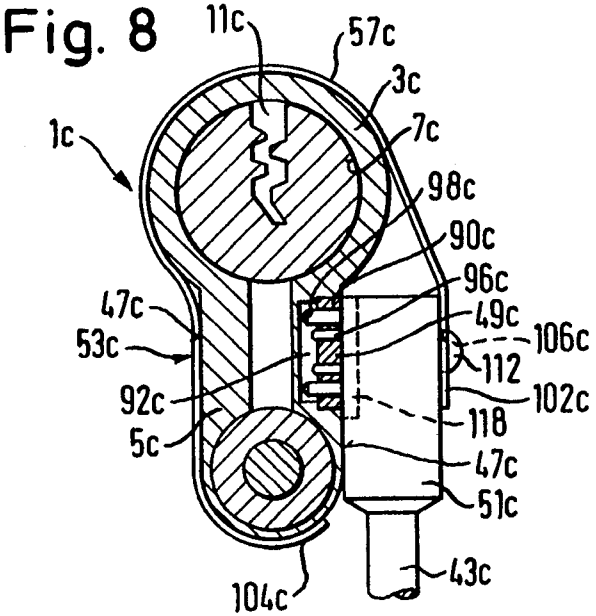
FIG. 8 is a cross of a variant of the embodiment according to FIGS. 7*a* to 7*d;*

FIG. 8 shows a variant of the example according to FIGS. 7a to 7d. Instead of the shoulders 106, the clamp 53c of the example according to FIG. 8 has an opening 106c in its end section 102c engaging behind the second plug part 51c. A rounded catch 112 of the second plug part 51c engages in this aperture 106c. In this way the second plug part 51c and the clamp 53c are fixed relative to one another transverse to the direction of unplugging with reference to all directions.

Figure 9A:
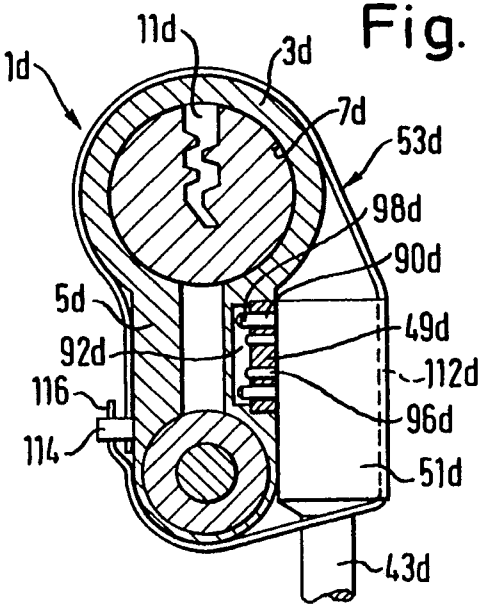
FIG. 9*a* is a cross-section of another variant of the embodiment according to FIGS. 7*a* to 7*d;*

Another variant of the example according to FIGS. 7a to 7d is shown in FIG. 9a. As retaining element 53d, there is provided a retaining band wrapped about the profile housing 1d and running through a groove 112d of the second plug part 51d on its side turned away from the contacting side. The retaining band 53d has a self-locking head 114 for the loop. Self-locking is realized in that the end 116 of the retaining band 53d drawn through the head 114 can no longer be slipped back toward the head 114, but in the as yet untightened state can still be drawn further through the head 114. Retaining bands of this type are known in electrical technology, e.g., as cable clamps.

Figure 9C:
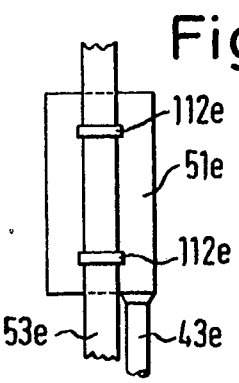
FIG. 9*c* is a corresponding view of a variant of the detail shown in FIG. 9*b;*
Figure 9B:
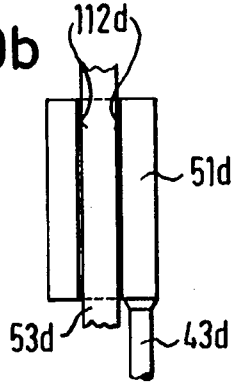
FIG. 9*b* is a right-side view of a detail of the lock cylinder of FIG. 9*a;*

FIG. 9b shows a detail cut-away section of the retaining band 53d running through the groove 112d in side view. It can be seen that the cable 43d is led away from the second plug part 51d displaced laterally with respect to the groove 112d.

A corresponding detail view is given as FIG. 9c. There, the retaining band 53e is drawn through loops 112e on the back of the second plug part 51e.

As indicated by broken lines in FIG. 8, an elastic sealing bead 118 is provided on the second plug part 51c, which, in the connected state, keeps moisture, dust and the like away from the plug contacts.

Figure 10:
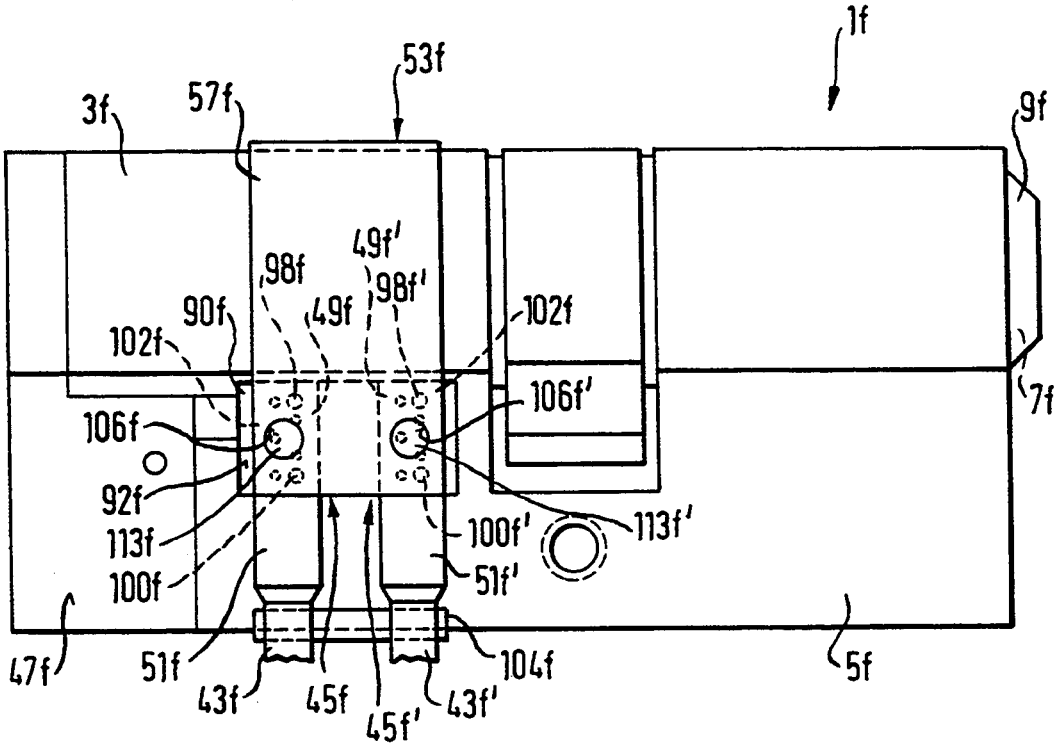
FIG. 10 is a side view of a further embodiment of the invention.

An additional example of the invention is shown in FIG. 10. The lock cylinder if of FIG. 10 is distinguished in that the circuit components of the control and power-supply circuit, disposed separate from the lock cylinder, are connected by way of two cables 43f and 43f' and two plug connectors 45f and 45f', with the direction of unplugging running perpendicular to the side wall 47f of the root section 5f, where the first plug parts 49f and 49f' are attached to the root section 5f and the second plug parts 51f, 51f' are secured by a common clamp 53f relative to the first plug parts 49f and 49f'. The clamp 53f has two openings 106f and 106f' in its end section 102f engaging behind the second plug parts 51f and 51f'. Rounded catches 113f and 113f' of the second plug parts 51f and 51f' engage in these apertures 106f and 106f'. The two plug connectors may be assigned to an information detection means or, optionally, to two separate information detection means.

We claim:

1. A lock cylinder comprising:

a profile housing (1) having a cylinder section (3) including a bore (7) and a root section (5) projecting radially from the cylinder section (3) and delimited by two side faces (47) extending approximately parallel along the cylinder section (3);

at least one cylinder core (9) disposed rotatably in the bore (7) of the profile housing (1) and lockable relative to the profile housing (1) by mechanical tumblers (15), a keyway (11) extending in the direction of the cylinder axis for a flat key (13) for controlling the tumblers (15);

information detection means (37) disposed on the profile housing (1) for contactless response to control information signals of a control circuit (29) of the flat key (13), the control circuit (29) being connected to an electronic control and power-supply circuit (31) disposed with at least some circuit components (39) separate from the lock cylinder, connection of the circuit components (39) separate from the lock cylinder being by way of a cable (43) and a plug connector (45) comprising a first plug part (49) and a second plug part (51); and a retaining part (53) which engages behind the second plug part (51) at least in a direction of unplugging and which secures the second plug part (51) relative to the first plug part (49), the retaining part (53) being capable of attachment to the profile housing (1);

wherein the first plug part (49) is fixed on the profile housing (1) and the cable (43) bears the second plug part (51) capable of being slipped on the first plug part, the first plug part (49) being disposed on one of the side faces (47) with a direction of unplugging along the side face.

2. The lock cylinder of claim 1, wherein the direction of unplugging is transversely away from the cylinder section (3).

3. The lock cylinder of claim 1, wherein the retaining part (53) overlaps at least the second plug part (51) in a direction of unplugging and in directions transverse thereto, and fixes the second plug part relative to the profile housing (1) between stops (67) facing one another.

4. The lock cylinder of claim 3, wherein the retaining part (53) includes, in a face adjacent to one of the side surfaces (47) of the root section (5), a depression (65) into which the two plug parts (49, 51) engage together.

5. The lock cylinder of claim 1, wherein at least the second plug part (51) is disposed in a depression (61) of the side surfaces (47) of the root section (5) delimited by shoulders (63) in a direction of unplugging on both sides of the second plug part (51), at a distance from the second plug part, and wherein the retaining part (53) has projections (67) on both sides of the second plug part (51) which engage in the depression (61) and fix the second plug part (51) and the retaining part (53) on the profile housing (1) transverse to the direction of unplugging.

6. The lock cylinder of claim 1, wherein the retaining part (53) extends over a side of the cylinder section (3) distant from the root section (5) and has at least one catch (75) which engages in a guide bore (77) of at least one of the tumblers (15).

7. The lock cylinder of claim 6, wherein the at least one of the tumblers (15) is innermost.

8. The lock cylinder of claim 1, wherein the first plug part (49) is disposed so that the direction of unplugging is transverse away from the cylinder section (3), and wherein the retaining part (53) extends over a side of the cylinder section (3) distant from the root section (5).

9. The lock cylinder of claim 1, wherein the retaining part is a clamp (53; 53*a*) adapted to a contour of the profile housing (1) and capable of being slipped on the profile housing (1) transverse to the cylinder axis.

10. The lock cylinder of claim 9, wherein at least the second plug part is flat, disposed flat on the root section (5), and wherein the clamp (53), in the region of an edge of the root section (5) distant from the cylinder section (3), has a cable passage opening (73) which, transverse to the clamp (53), is more narrow than the flat-side width of the plug part (51), and which, along the clamp (53), has an opening width that permits passage of the plug part (51).

11. The lock cylinder of claim 10, wherein the cable passage opening (73) engages the edge of the root section (5).

12. The lock cylinder of claim 1, wherein the cable.(43) is connected to the second plug part (51) eccentric to the center thereof.

13. The lock cylinder of claim 9, wherein the clamp (53) is substantially U-shaped and comprises a first arm (57), a second arm (59) and a crosspiece (55) connecting the first arm (57) and the second arm (59), and wherein the first arm (57) engages the cylinder section (3), the second arm (59) engages a face of the root section (5) distant from the cylinder section (3), and the crosspiece (55) covers the two plug parts (49, 51).

14. The lock cylinder of claim 1 comprising two cables (43*a*) and two plug connectors (45*a*), each plug connector having the first plug part (49*a*) and the second plug part (51*a*), wherein the profile housing comprises two cylinder cores (9*a*) separated from one another axially into two cylinder sections (3) by a lockable part and joined by a common root section (5), and information transmitting means (37) for the transmission of control information signals of the flat key (13) is associated with at least one of the two cylinder cores (9*a*), the circuit components (39) of the control and power-supply circuit (31) disposed separate from the lock cylinder being connected by the two cables (43*a*) and the two plug connectors (45*a*), the first plug parts (49*a*) of which are attached to the root section (5*a*) and the second plug parts (51*a*) of which are attached to the respective cables (43*a*), both second plug parts (51*a*) being secured against unplugging by a common retaining part (53*a*).

15. The lock cylinder of claim 14, wherein the first plug parts (49*a*) are disposed on the side faces (47*a*) of the root section (5*a*) facing one another, and the retaining part is a clamp (53*a*) enclosing the profile housing between two arms (83) extending transverse to the cylinder axis, each of the arms (83) having means for fixation of the respective second plug part (51*a*).

16. The lock cylinder of claim 15, wherein the arms (83) have a shape adapted to a contour of the profile housing and surround the profile housing substantially completely.

17. The lock cylinder of claim 16, wherein the arms (83) are joined by an articulating joint (81) and, at ends distant from the joint (81), have locking members (75*a*) for fixation on the profile housing.

18. The lock cylinder of claim 16, wherein the joint (81) connects ends of the arms (83) adjacent to the root section (5*a*).

19. A lock cylinder comprising:

a profile housing (1*b* . . . 1*d*; 1*f*) having a cylinder section (3*b* . . . 3*d*; 3*f*) which includes a bore (7*b* . . . 7*d*; 7*f*) and a root section (5*b* . . . 5*d*; 5*f*) projecting radially from the cylinder section and delimited by two side faces (47*b* . . . 47*d*; 47*f*) extending substantially parallel along the cylinder section;

at least one cylinder core (9*b* . . . 9*d*; 9*f*) disposed rotatably in the bore of the profile housing and lockable relative to the profile housing by mechanical tumblers (15), a keyway (11) extending in the direction of the cylinder axis for a flat key (13) for controlling the tumblers (15);

information detection means (37) disposed on the profile housing for contactless response to control information signals of a control circuit (29) of the flat key (13), the control circuit (29) being connected to an electronic control and power-supply circuit (31) disposed with at least some circuit components (39) separate from the lock cylinder, connection of the circuit components (39) separate from the lock cylinder being by way of a cable (43) and a plug connector (45) comprising a first plug part (49) and a second plug part (51), the first and second plug parts each having respective electrical contact elements; and a retaining part (53) which engages behind the second plug part at least in a direction of unplugging and which secures the second plug part relative to the first plug part, the retaining part (53) being capable of attachment to the profile housing;

wherein the first plug part is fixed on the profile housing and the cable (43) bears the second plug part capable of being slipped on the first plug part, the first plug part being disposed on the root section in the region of one of the side faces (47*b* . . .

47*d*; 47*f*), with the direction of unplugging running transverse to the side faces (47*b* . . . 47*d*; 47*f*);

at least one of the plug parts (51*b* . . . 51*d*; 51*f*, 51*f'*), near the electrical contact elements thereof, ham plug-guidance and fixing members (98; 98*c*; 98*d*; 98*f*, 98*f'*) which, upon alignment of the respective electrical contact elements of the two plug parts to one another, are capable of insertion into plug-guidance and fixing openings (100; 100*c*; 100*d*; 100*f*, 100*f'*) of the other plug part (49*b* 49*d*; 49*f*, 49*f'*); and the electrical contact elements of the plug part (51*b* . . . 51*d*; 51*f*, 51*f'*) provided with the plug-guidance and fixing members (98; 98*c*; 98*d*; 98*f*) do not project outward from the plug part beyond the plug-guidance and fixing members (98; 98*c*; 98*d*; 98*f*, 98*f'*).

20. A lock cylinder comprising:

a profile housing (1*b* . . . 1*d*; 1*f*) having a cylinder section (3*b* . . . 3*d*; 3*f*) which includes a bore (7*b* . . . 7*d*; 7*f*) and a root section (5*b* . . . 5*d*; 5*f*) projecting radially from the cylinder section and delimited by two side faces (47*b* . . . 47*d*; 47*f*) extending substantially parallel along the cylinder section;

at least one cylinder core (9*b* . . . 9*d*; 9*f*) disposed rotatably in the bore of the profile housing and lockable relative to the profile housing by mechanical tumblers (15), a keyway (11) extending in the direction of the cylinder axis for a flat key (13) for controlling the tumblers (15);

information detection means (37) disposed on the profile housing for contactless response to control information signals of a control circuit (29) of the flat key (13), the control circuit (29) being connected to an electronic control and power-supply circuit (31) disposed with at least some circuit components (39) separate from the lock cylinder, connection of the circuit components (39) separate from the lock cylinder being by way of a cable (43*b* . . . 43*e*; 43*f*, 43*f'*) and a plug connector (45) comprising a first plug part and a second plug part; and a retaining part (53) which engages behind the second plug part at least in a direction of unplugging and which secures the second plug part relative to the first plug part, the retaining part (53) being capable of attachment to the profile housing;

wherein the first plug part is fixed on the profile housing and the cable bears the second plug part capable of being slipped on the first plug part, the first plug part being disposed on the root section in the region of one of the side faces (47*b* . . . 47*d*; 47*f*), with the direction of unplugging running transverse to the side faces (47*b* . . . 47*d*; 47*f*); and wherein the cable is led away from the second plug part (51*b* . . . 51*e*; 51*f*, 51*f'*) transverse to the direction of unplugging, in a direction away from the cylinder section (3*b* . . . 3*d*; 3*f*).

21. A lock cylinder comprising:

a profile housing (1*b* . . . 1*d*; 1*f*) having a cylinder section (3*b* . . . 3*d*; 3*f*) which includes a bore (7*b* . . . 7*d*; 7*f*) and a root section (5*b* . . . 5*d*; 5*f*) projecting radially from the cylinder section and delimited by two side faces (47*b* . . . 47*d*; 47*f*) extending substantially parallel along the cylinder section;

at least one cylinder core (9*b* . . . 9*d*; 9*f*) disposed rotatably in the bore of the profile housing and lockable relative to the profile housing by mechanical tumblers (15), a keyway (11) extending in the direction of the cylinder axis for a flat key (13) for controlling the tumblers (15);

information detection means (37) disposed on the profile housing for contactless response to control information signals of a control circuit (29) of the flat key (13), the control circuit (29) being connected to an electronic control and power-supply circuit (31) disposed with at least some circuit components (39) separate from the lock cylinder, connection of the circuit components (39) separate from the lock cylinder being by way of a cable (43*b* . . . 43*e*; 43*f*, 43*f'*) and a plug connector (45) comprising a first plug part and a second plug part; and a clamp (53*b* . . . 53*d*; 53*f*) which engages behind the second plug part at least in a direction of unplugging and which secures the Second plug part relative to the first plug part, the clamp being adapted at least sectionwise to the cross-sectional contour of the profile housing (1*b* . . . 1*d*; 1*f*) and capable of placement on the profile housing;

wherein the first plug part is fixed on the profile housing and the cable bears the second plug part capable of being slipped on the first plug part, the first plug part being disposed on the root section in the region of one of the side faces (47*b* . . . 47*d*; 47*f*), with the direction of unplugging running transverse to the side faces (47*b* . . . 47*d*; 47*f*); and wherein the clamp has an upper section (57*b*; 57*c*; 57*f*) engaging the cylinder section (3*b*; 3*c*; 3*f*) from the side face of the root section (5*b*; 5*c*; 5*f*) distant from the plug connection with a free end (102; 102*c*; 102*f*) engaging behind the second plug part (51*b*; 51*c*; 51*f*, 51*f'*) and a lower clamp section (59*b*; 59*c*; 59*f*) engaging the edge of the root section (5*b*; 5*c*; 5*f*) located distant from the cylinder section (3*b*; 3*c*; 3*f*) from the side face of the root section (5*b*; 5*c*; 5*f*) with a free end (104; 104*c*; 104*f*).

22. A lock cylinder comprising:

a profile housing (1*b* . . . 1*d*; 1*f*) having a cylinder section (3*b* . . . 3*d*; 3*f*) which includes a bore (7*b* . . . 7*d*; 7*f*) and a root section (5*b*. . . 5*d*; 5*f*) projecting radially from the cylinder section and delimited by two side faces (47*b* . . . 47*d*; 47*f*) extending substantially parallel along the cylinder section;

at least one cylinder core (9*b* . . . 9*d*; 9*f*) disposed rotatably in the bore of the profile housing and lockable relative to the profile housing by mechanical tumblers (15), a keyway (11) extending in the direction of the cylinder axis for a flat key (13) for controlling the tumblers (15);

information detection means (37) disposed on the profile housing for contactless response to control information signals of a control circuit (29) of the flat key (13), the control circuit (29) being connected to an electronic control and power-supply circuit (31) disposed with at least some circuit components (39) separate from the lock cylinder, connection of the circuit components (39) separate from the lock cylinder being by way of a cable (43*b* . . . 43*e*; 43*f*, 43*f'*) and a plug connector (45) comprising a first plug part and a second plug part; and a retaining band (53*d*, 53*e*) which engages behind the second plug part at least in a direction of unplugging and which secures the second plug part relative to the first plug part, the retaining band being capable of attachment to the profile housing, and the retaining band passing between two projections (at 112*d*; at 112*e*) of the second plug part (51*d*; 51*e*)

for its fixation transverse to the direction of unplugging and wrappable about the profile housing (1*d*; 1*e*) and the second plug part (51*d*; 51*e*);

wherein the first plug part is fixed on the profile housing and the cable bears the second plug part capable of being slipped on the first plug part, the first plug part being disposed on the root section in the region of one of the side faces (47*b* . . . 47*d*; 47*f*), with the direction of unplugging running transverse to the side faces (47*b* . . . 47*d*; 47*f*).

* * * * *

UNITED STATES PATENT AND TRADEMARK OFFICE

CERTIFICATE OF CORRECTION

PATENT NO. : 5,373,718

DATED : December 20, 1994

INVENTOR(S) : Franz Schwerdt et al.

It is certified that error appears in the above-indentified patent and that said Letters Patent is hereby corrected as shown below:

Col. 14, line 16, "if" should read 1f--;
Col. 14, line 19, "43f and 43f" should read --43f and 43f'--;
Col. 14, line 20, "45f and 45f" should read --45f and 45f'--;
Col. 14, line 23, "49f" should read --49f'--;
Col. 14, line 24, "51f, 51f" should read --51f, 51f'--;
Col. 14, line 25, "49f and 49f" should read --49f and 49f'--;
Col. 14, line 26, "106f and 106f" should read --106f and 106f'--;
Col. 14, line 27, "51f and 51f" should read --51f and 51f'--;
Col. 14, line 28, "113f and 113f" should read --113f and 113f'--;
Col. 14, line 29, "51f and 51f" should read --51f and 51f'--;
Col. 14, line 29, "106f and 106f" should read --106f and 106f'--;
Col. 17, line 3, "51f, 51f" should read --51f, 51f'--;
Col. 17, line 4, "ham" should read --has--;
Col. 17, line 6, "98f, 98f" should read --98f, 98f'--;
Col. 17, line 10, "100f" should read --100f'--;
Col. 17, line 10, "49f, 49f" should read --49f, 49f'--;
Col. 17, line 12, "51f, 51f" should read --51f, 51f'--;
Col. 17, line 16, "98f, 98f" should read --98f, 98f'--;
Col. 17, line 40, "43f, 43f" should read --43f, 43f'--;
Col. 17, line 55, "51f, 51f" should read --51f, 51f'--;

UNITED STATES PATENT AND TRADEMARK OFFICE

CERTIFICATE OF CORRECTION

PATENT NO. : 5,373,718

DATED : December 20, 1994

INVENTOR(S) : Franz Schwerdt et al.

It is certified that error appears in the above-indentified patent and that said Letters Patent is hereby corrected as shown below:

Col. 18, line 12, "43f, 43f" should read --43f, 43f'--;
Col. 18, line 16, "Second" should read --second--;
Col. 18, line 33, "51f, 51f" should read --51f, 51f'--;
Col. 18, line 60, "43f, 43f" should read --43f, 43f'--.

Signed and Sealed this

Eighteenth Day of April, 1995

Bruce Lehman

*Attest:*

BRUCE LEHMAN

*Commissioner of Patents and Trademarks*

*Attesting Officer*